US008695901B2

(12) United States Patent
Hornby et al.

(10) Patent No.: US 8,695,901 B2
(45) Date of Patent: Apr. 15, 2014

(54) INDUCTIVE HEATED INJECTOR USING A THREE WIRE CONNECTION

(75) Inventors: Michael J. Hornby, Williamsburg, VA (US); John F. Nally, Jr., Williamsburg, VA (US); Hamid Sayar, Newport News, VA (US); Perry Robert Czimmek, Williamsburg, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1778 days.

(21) Appl. No.: 11/689,088

(22) Filed: Mar. 21, 2007

(65) Prior Publication Data

US 2007/0221761 A1 Sep. 27, 2007

Related U.S. Application Data

(60) Provisional application No. 60/784,697, filed on Mar. 22, 2006.

(51) Int. Cl.
*B05B 1/30* (2006.01)

(52) U.S. Cl.
USPC ..... 239/585.1; 239/133

(58) Field of Classification Search
USPC ..... 239/585.1, 128, 533.12, 88, 133, 134, 239/584, 585.3, 585.4, 585.5, 533.2, 89, 239/91; 251/129.15, 129.21, 127
See application file for complete search history.

(56) References Cited

U.S. PATENT DOCUMENTS

| | | | | |
|---|---|---|---|---|
| 3,601,110 | A | 8/1971 | Kamazuka | |
| 3,839,906 | A | 10/1974 | Hanson | |
| 4,870,943 | A * | 10/1989 | Bradley | 123/558 |
| 4,934,907 | A | 6/1990 | Kroner | |
| 5,040,497 | A | 8/1991 | Dingle | |
| 5,159,915 | A | 11/1992 | Saito et al. | |
| 5,201,341 | A * | 4/1993 | Saito et al. | 137/341 |
| 5,487,114 | A | 1/1996 | Dinh | |
| 5,666,929 | A * | 9/1997 | Knowlton et al. | 123/546 |
| 5,758,826 | A | 6/1998 | Nines | |
| 5,787,857 | A | 8/1998 | Simons | |
| 5,915,626 | A | 6/1999 | Awarzamani et al. | |
| 6,109,543 | A | 8/2000 | Bright et al. | |
| 6,315,217 | B1 | 11/2001 | Park | |
| 6,422,481 | B2 | 7/2002 | Ren et al. | |
| 6,550,458 | B2 | 4/2003 | Yamakado et al. | |
| 6,561,168 | B2 | 5/2003 | Hokao et al. | |
| 6,578,775 | B2 | 6/2003 | Hokao | |
| 6,651,602 | B2 | 11/2003 | Hiraku et al. | |
| 6,721,158 | B2 | 4/2004 | Heinke | |
| 6,728,602 | B2 | 4/2004 | Husted et al. | |
| 7,481,376 | B2 * | 1/2009 | Hornby et al. | 239/5 |

(Continued)

FOREIGN PATENT DOCUMENTS

| | | |
|---|---|---|
| DE | 4431189 | 3/1996 |
| DE | 4431189 A1 | 3/1996 |

(Continued)

*Primary Examiner* — Davis Hwu

(57) ABSTRACT

A fuel injector assembly includes a first coil driven by a direct current driver and a second coil driven by an alternating current driver where both the first coil and the second coil share a common connection to reduce the number of external terminal connections. The second coil generates a second magnetic field that is utilized to heat a component in thermal contact with the fuel flow that in turn heats fuel before exiting the fuel injector.

18 Claims, 2 Drawing Sheets

(56) References Cited

U.S. PATENT DOCUMENTS

| | | | |
|---|---|---|---|
| 2002/0139872 | A1 | 10/2002 | Hokao |
| 2003/0178009 | A1 | 9/2003 | Pellizzari et al. |
| 2005/0258266 | A1 | 11/2005 | Elia et al. |
| 2005/0279867 | A1 | 12/2005 | Ismailov |
| 2007/0200006 | A1 | 8/2007 | Czimmek |
| 2007/0221748 | A1 | 9/2007 | Hornby et al. |
| 2007/0221874 | A1 | 9/2007 | Hornby et al. |
| 2007/0235086 | A1 | 10/2007 | Hornby et al. |
| 2007/0235557 | A1 | 10/2007 | Hornby et al. |

FOREIGN PATENT DOCUMENTS

| | | | |
|---|---|---|---|
| DE | 10057630 | | 5/2002 |
| GB | 2307513 | | 5/1997 |
| GB | 2307513 | A | 5/1997 |
| JP | 05288131 | | 11/1993 |
| JP | 09264224 | | 10/1997 |
| JP | 10238424 | | 9/1998 |
| JP | 10238424 | A | 9/1998 |
| JP | 2002180919 | | 6/2002 |
| WO | 0166933 | A1 | 9/2001 |

* cited by examiner

INDUCTIVE HEATED INJECTOR USING A THREE WIRE CONNECTION

CROSS REFERENCE TO RELATED APPLICATION

The application claims priority to U.S. Provisional Application No. 60/784,697 which was filed on Mar. 22, 2006.

BACKGROUND OF THE INVENTION

This invention generally relates to a fuel injector for a combustion engine. More particularly, this invention relates to a fuel injector that heats fuel to aid the combustion process.

Combustion engine suppliers continually strive to improve emission and combustion performance. One method of improving both emission and combustion performance includes heating or vaporizing fuel before injection into the combustion chamber. Heating the fuel replicates operation of a hot engine, and therefore improves combustion performance. Further, alternate fuels such as ethanol perform poorly in cold conditions, and therefore also benefit from pre-heating of fuel.

Various methods of heating fuel at a fuel injector have been attempted. Such methods include the use of a ceramic heater, or a resistively heated capillary tube within which the fuel passes. These methods require electric power and therefore leads that extend through pressure barriers and walls. Seals required between the wires and pressure barriers are a potential source of fuel leakage and are therefore undesirable. Further, such heat generating devices must be insulated from other fuel injector components and therefore are difficult to implement and support within a fuel injector.

One consideration for all automotive components is the number of connections to any electronic or electromechanical device. The more terminals and wired connections the more support connections to electronic control units and other control devices. Each additional terminal adds cost in materials and assembly time.

Accordingly, it is desirable to design and develop a method of heating fuel without creating additional fuel leak paths, or insulating structures while minimizing the number of electrical connections and still providing for the heating and vaporization of fuel.

SUMMARY OF THE INVENTION

An example fuel injector assembly includes a first coil driven by a DC current driver and a second coil driven by an AC driver where both the first coil and the second coil share a common connection to reduce the number of external terminal connections.

The example fuel injector includes the first coil that receives the first signal from the DC driver to generate a first magnetic field that moves an armature between the open and closed positions. The second coil generates a second magnetic field that is utilized to heat a component in thermal contact with the fuel flow that in turn heats fuel before exiting the fuel injector. The heated fuel is raised to a temperature that substantially vaporizes the liquid fuel to achieve a high level of atomization that in turn improves combustion performance.

The example fuel injector assembly includes three terminals, one to the DC driver, one to the AC driver, and one to a common voltage buss. Therefore voltage is always supplied to the first coil and the second coil and switching is performed by controlling the connection to ground. A high pass filter is disposed within the fuel injector assembly to prevent the AC signal from interfering with the DC signal within the first coil.

Accordingly, the example fuel injector assembly requires only three terminals or external connections for operation.

These and other features of the present invention can be best understood from the following specification and drawings, the following of which is a brief description.

DETAILED DESCRIPTION OF THE PREFERRED EMBODIMENT

Figure 1:
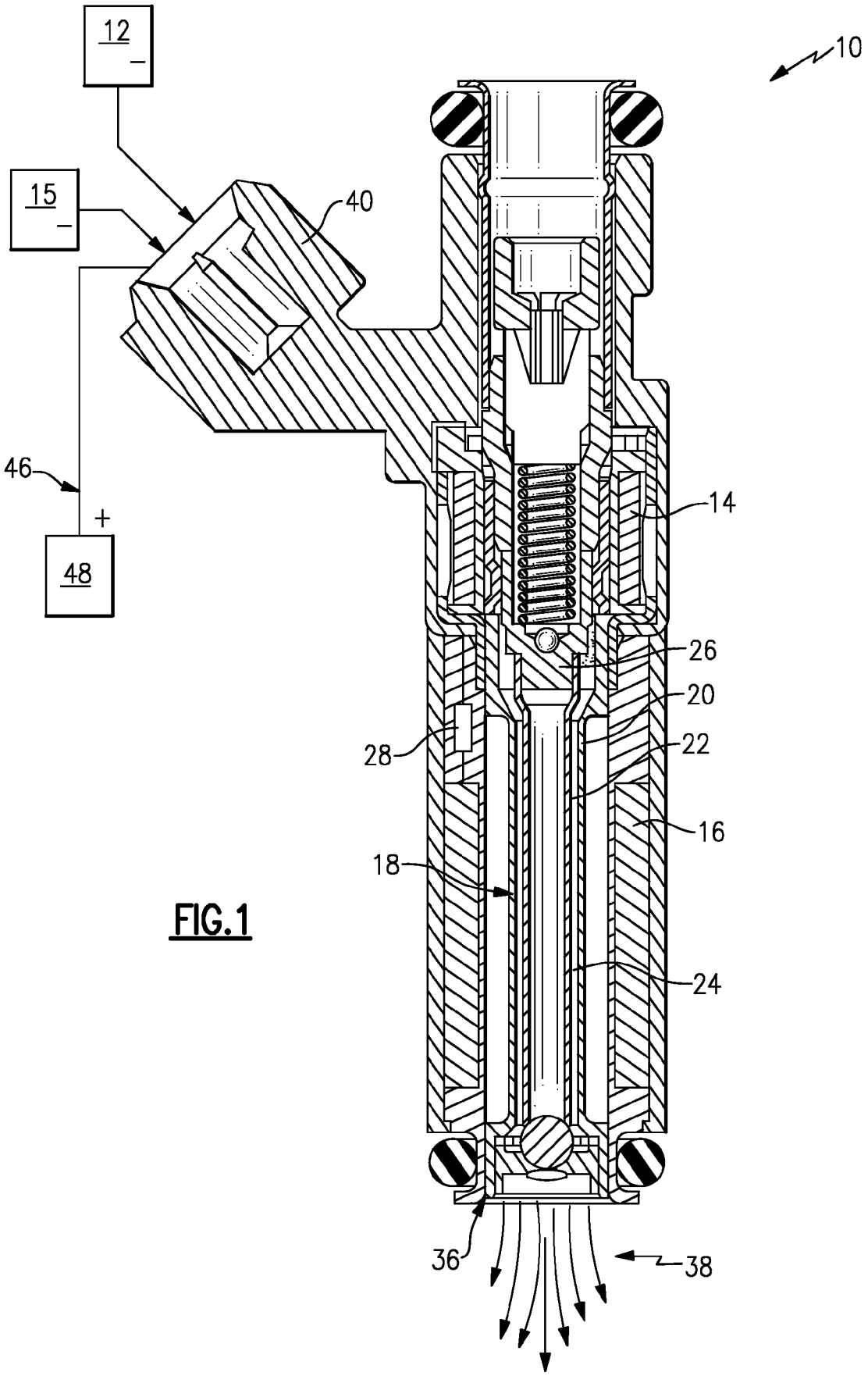
FIG. 1 is a cross-section of an example fuel injector assembly.

Referring to FIG. 1, an example fuel injector 10 includes an annular fuel flow path 24 defined between an armature 26 and a valve body 20. The armature 26 moves within the valve body 20 between an open and closed position to regulate fuel flow 18 through the annular flow path 24. A first coil 14 receives a first signal from a direct current (DC) driver 12 to generate a first magnetic field that moves the armature 26 between the open and closed positions. A second coil 16 generates a second magnetic field that is utilized to heat a component in thermal contact with the fuel flow 18 that in turn heats fuel before exiting the fuel injector 10 through the outlet 36. The heated fuel exiting the outlet 36 as indicated at 38 is raised to a temperature that substantially vaporizes the liquid fuel to achieve a high level of atomization that in turn improves combustion performance.

The component in thermal contact with the fuel flow 18 in this example is an armature tube 22 of the armature 26. The armature tube 22 is disposed within the fuel flow 18. The armature tube 22 is fabricated from a magnetically active material that responds to a magnetic field. The second coil 16 generates a second magnetic field surrounding and interacting with the armature tube 22. The second magnetic field is generated by an alternating current provided by an alternating (AC) driver 15. The alternating current from the AC driver 15 produces a time varying second magnetic field in the second coil 16.

The frequency of the alternating current that generates the second magnetic field is such that movement of the armature 26 is not induced. No movement of the armature 26 is induced because the frequency of the alternating current results in a time varying and reversing second magnetic field. Heat inside the armature tube 22 is generated by hysteretic and eddy-current loses that are induced by the time varying second magnetic field. The amount of heat generated is responsive to the specific resistivity of the material of the armature tube 22 and the characteristics of the alternating current signal. The time varying second magnetic field produces a flux flow in the surface of the material that alternates direction to generate heat. The higher the resistivity of the material the better the generation of heat responsive to the second magnetic field.

The connector 40 includes connections to DC driver 12, the AC driver 15 and to a positive voltage buss 48. It is desirable in many applications to reduce the number of terminals to an electronic device in order to reduce overall system complexity and cost. In the example fuel injector assembly 10, the connector 40 includes three terminals, one to the DC driver 12, one to the AC driver, and one to the common voltage bus 48. The high side connection 46 is common between the first coil 14 and the second coil 16. A high pass filter 28 is disposed within the fuel injector assembly 10 to prevent the alternating current signal from interfering with the direct current signal within the first coil 14.

Figure 2:
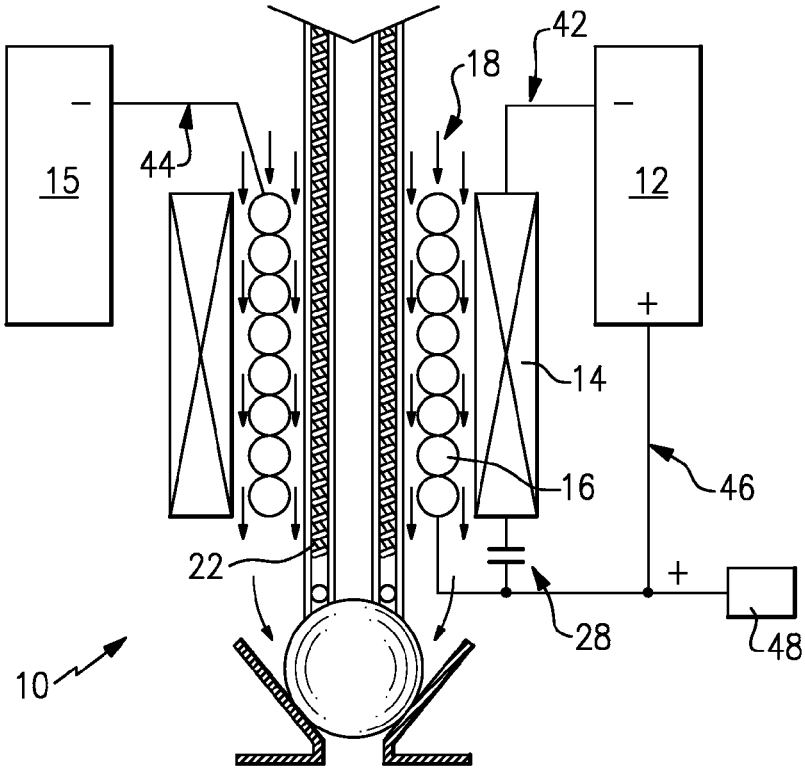
FIG. 2 is a schematic view of the example fuel injector assembly.

Referring to FIG. 2, the fuel injector assembly 10 is illustrated with the second coil 16 nested within the first coil 14 and disposed coaxially about fuel flow 18. The AC driver 15 sends the alternating current signal 44 to the second coil 16. The DC driver 12 sends a direct current signal 42 to the first coil 14. The direct current signal 42 generates the first magnetic field that is utilized to move the armature 26. The alternating current signal 44 produces a time varying and reversing magnetic field that heats up the components within the field. In this example, the armature tube 22 is heated, although other components such as the valve body 20 could also be heated.

Because the first and second coils 14, 16 are connected to the common voltage bus 48, a signal separator is provided to prevent the alternating current 32 from interfering with operation of the first coil 14 and operation of the armature 26. The example single separator comprises a high pass filter 28 that prevents alternating current from entering the first coil 14. The example single separator comprises a capacitor 28. As appreciated, other devices and circuit configurations that perform the function of preventing interference of the first coil could also be used and are within the contemplation of this invention.

Figure 3:
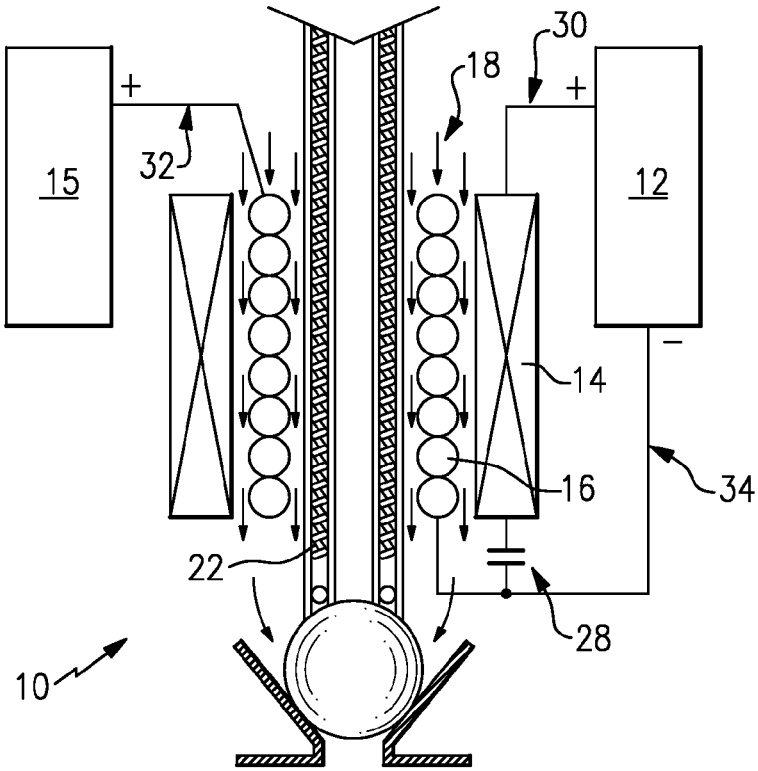
FIG. 3 is a schematic view of another example fuel injector assembly.

Referring to FIG. 3, another example fuel injector assembly 10 includes a common connection to ground 34. In this example, each of the DC driver 12 and the AC driver 15 controls current to the respective first and second coils 14, 16 by switching a positive lead 30 from the DC driver 12 and a positive lead 32 from the AC driver. The common ground connection 34 is to ground 34 as indicated in this example. This configuration provides the desired three-wire connection to reduce the overall terminals and connections and an alternative way of controlling power to the first and second coils 14, 16.

Accordingly, the example fuel injector assembly requires only three terminals or external connections for operation. The separate AC driver 15 and DC driver 12 share either a common ground 34, or a common connection to a voltage buss 48 to eliminate separate connections to each of the driven coils.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel injector assembly comprising:

a first coil for generating a first magnetic field responsive to a first signal;

a second coil generating a second magnetic field responsive to a second signal;

a first driver including a first lead electrically connected to the first coil;

a second driver including a second lead electrically connected to the second coil;

a common lead connected to both the first coil and the second coil; and a component within thermal contact with a fuel flow path that is heated responsive to the second magnetic field generated by the second coil.

2. The assembly as recited in claim 1, wherein the first signal comprises a direct current signal and the second signal comprises an alternating current signal.

3. The assembly as recited in claim 2, including a high pass filter preventing alternating current from interfering with the direct current to the first coil.

4. The assembly as recited in claim 2, wherein the first signal and the second signal operate independent of each other.

5. The assembly as recited in claim 1, including an armature movable responsive to the first magnetic field for controlling a flow of fuel, wherein a portion of the armature is inductively heated by the second magnetic field.

6. The assembly as recited in claim 5, including an armature movable within a valve body that defines an annular fuel flow channel between the armature and the tube.

7. The assembly as recited in claim 1, wherein the second magnetic field induces hysteretic and eddy current loses that heat the component within the fuel flow path.

8. The assembly as recited in claim 1, wherein the common lead comprises a ground connection.

9. The assembly as recited in claim 1, wherein the common lead comprises a connection to a common voltage buss.

10. A method of heating fuel comprising the steps of:

a) generating a first magnetic field in a first coil responsive to a first signal from a first driver;

b) generating a second magnetic field in a second coil responsive to a second signal from a second driver;

c) attaching the first coil and the second coil to a common connection; and c) heating a component within a flow of fuel with the second magnetic field generated by the second coil.

11. The method as recited in claim 10, wherein the first signal is a direct current signal and the second signal is an alternating current.

12. The method as recited in claim 10, wherein a high pass filter is disposed on the common connection between the first coil and the second coil for preventing the alternating current signal to the second coil from interfering with the direct current to the first coil.

13. The method as recited in claim 10, including the step of controlling the flow of fuel with the first magnetic field generated by the first coil.

14. The method as recited in claim 10, including the step of controlling movement of an armature between an open and closed position.

15. The method as recited in claim 10, wherein said step c, comprises generating a time varying magnetic field with the alternating current signal that acts on the component within the flow of fuel with the time varying magnetic field.

16. The method as recited in claim 10, wherein the common connection comprises a connection to a common ground.

17. The method as recited in claim 10, wherein the common connection comprises a connection to a common voltage buss.

18. The method as recited in claim 15, wherein the component within the fuel flow comprises an armature movable responsive to the first magnetic field that is heated by the second magnetic field.

* * * * *